US011179625B2

(12) United States Patent
Bauer

(10) Patent No.: US 11,179,625 B2
(45) Date of Patent: Nov. 23, 2021

(54) FLICK FOOTBALL GAME AND METHOD OF PLAYING

(71) Applicant: Craig M. Bauer, Pittsburgh, PA (US)

(72) Inventor: Craig M. Bauer, Pittsburgh, PA (US)

( * ) Notice: Subject to any disclaimer, the term of this patent is extended or adjusted under 35 U.S.C. 154(b) by 94 days.

(21) Appl. No.: 16/536,052

(22) Filed: Aug. 8, 2019

(65) Prior Publication Data

US 2020/0047060 A1 Feb. 13, 2020

Related U.S. Application Data

(60) Provisional application No. 62/715,972, filed on Aug. 8, 2018.

(51) Int. Cl.
*A63F 3/00* (2006.01)

(52) U.S. Cl.
CPC ..... *A63F 3/00041* (2013.01); *A63F 3/00214* (2013.01); *A63F 2003/00223* (2013.01)

(58) Field of Classification Search
CPC ... A63B 67/002; A63B 67/06; A63F 3/00041; A63F 7/0616; A63F 7/0668; A63F 7/0612; A63F 2003/00766; A63F 2003/00223
USPC ..... 273/317.5, 398, 402, 342, 108.4
See application file for complete search history.

(56) References Cited

U.S. PATENT DOCUMENTS 4,733,867 A * 3/1988 Kemp ..... A63F 7/0668 273/108.5
4,802,880 A * 2/1989 Shaw ..... A63F 7/40 273/317.5
5,570,888 A * 11/1996 Robinson ..... A63F 7/0668 273/108.4
5,673,912 A * 10/1997 Bonk ..... A63F 7/40 273/108.4
6,439,575 B1 * 8/2002 Castellanos ..... A63F 7/06 273/108.4
7,144,014 B2 * 12/2006 Schaub, Jr. ..... A63F 3/00028 273/317.5
7,717,431 B2 * 5/2010 Pettis ..... A63F 7/06 273/317.5
D743,491 S * 11/2015 Fissell ..... D21/397
D873,919 S * 1/2020 Emmerson ..... D21/303
10,729,958 B1 * 8/2020 Coffey ..... A63B 63/004
2003/0034611 A1 * 2/2003 Lacy ..... A63F 7/0612 273/317.3
2007/0001399 A1 * 1/2007 Staver ..... A63B 67/06 273/317.3

(Continued)

FOREIGN PATENT DOCUMENTS

WO WO-2011105983 A1 * 9/2011 ..... A63B 67/066

*Primary Examiner* — Joshua T Kennedy
(74) *Attorney, Agent, or Firm* — Gary P. Topolosky

(57) ABSTRACT

A finger flicking football game comprises a waterproof triangular-shaped football for finger flicking and a pair of transportable game boards. Each game board comprises: a planar table surface having a plurality of apertures, each aperture designed to hold a cup sized for playing beer pong, and a pair of goal posts hinged from a rear end of each planar table surface. During game play, the players take turns flicking the football towards the cups in the other player's game board. Should their flicked football land in a cup, that player has scored a six point touchdown and can proceed to finger flick the football towards the other players goal posts for scoring an extra point.

7 Claims, 3 Drawing Sheets

(56) References Cited

U.S. PATENT DOCUMENTS

| | | | | |
|---|---|---|---|---|
| 2007/0093174 | A1* | 4/2007 | Cheung | A63H 13/02<br>446/336 |
| 2012/0225742 | A1* | 9/2012 | Max | A63B 63/08<br>473/481 |
| 2014/0252718 | A1* | 9/2014 | Rieman | A63B 67/002<br>273/342 |
| 2015/0137452 | A1* | 5/2015 | Dahl | A63F 7/0017<br>273/342 |
| 2019/0060729 | A1* | 2/2019 | Saleeby | A63B 67/02 |

* cited by examiner

FLICK FOOTBALL GAME AND METHOD OF PLAYING

CROSS REFERENCE TO RELATED APPLICATION

This application is a perfection of U.S. Provisional Ser. No. 62/715,972, filed on Aug. 8, 2018, the disclosure of which is fully incorporated herein.

BACKGROUND OF THE INVENTION

1. Field of the Invention

This invention relates to tailgate party games and/or yard games. It is also suitable for indoor play at a bar (as part of a league) or house party. It is much more than a mere merging of cornhole and beer pong. It adds a skill level to the foregoing as was once practiced in our youth, that of tabletop football using a tri-folded paper football. In this case, the football to-be-flicked must be more waterproof so as to survive repeated dunkings in a cup containing beer or another suitable party liquor.

2. Description of Prior Art

It is known that many games played by teams of players on large outdoor fields have been miniaturized so that one or two players can play a simulation of the game at home, such as on a table top. This has occurred for games such as baseball, tennis, hockey, football and the like.

In a conventional children's tabletop game of "football" using a football made by folding paper into a triangle, goal posts are made with the player's fingers and touchdowns were scored when the paper triangle hangs over the edge of the table without falling off. The duly held football was then kicked through the finger-uprights in order to score an extra point. It is now believed that such playing elements of this game can be improved for greater enjoyment.

Representative prior art pertinent to this disclosure includes: U.S. Design Pat. Nos. D 706,355 and D 763,358, U.S. Published Application Nos. 20110148036 and 20170173427, and U.S. Pat. No. 4,733,867.

SUMMARY OF THE INVENTION

Accordingly, it is a principal object of the present invention to provide a game wherein the playing field and ball will be standardized, allowing consistency thereof throughout the country. Rules will be made easy to follow, and will be provided with each purchase of a set of the game. The playing field will be transportable and duly marked for scoring. A current proposal for marketing the game is under the trademark: FLICK TO 42 (i.e., the winning score per one set of preferred game rules).

Other objects are to provide a Flick Football game board which is simple in design, inexpensive to manufacture and to purchase, and which gives a pleasant diversion to players of all ages.

These and other objects will be readily evident upon a study of the following specification and the accompanying drawing.

BRIEF DESCRIPTION OF THE DRAWINGS

Further features, objectives and advantages of this invention will be made apparent from the following Detailed Description made with reference to the accompanying drawings in which.

DESCRIPTION OF PREFERRED EMBODIMENTS

Figure 1:
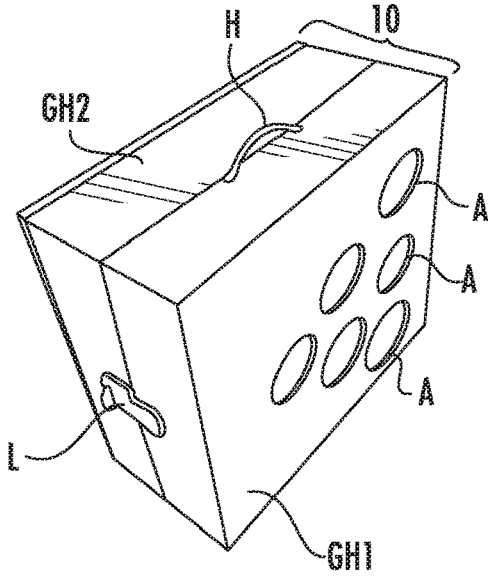
FIG. 1 is a top perspective view of the two main player game halves GH1 and GH2 joined together for transport, collectively item 10, with the remaining playing pieces (i.e. beer bong cups BPC, flick footballs TF or PBF and goalpost pairs GP-L, GP-R) being stored inside until needed.
Figure 2:
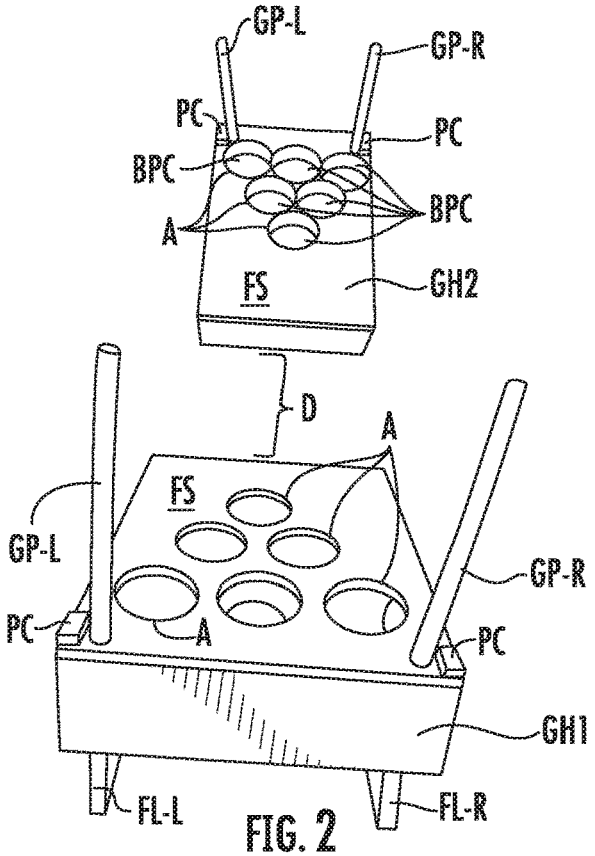
FIG. 2 is a top perspective view of the two main player game halves from FIG. 1, GH1 and GH2, opened up and spaced apart a representative distance D, note that beer pong cups BPC have only been inserted into the farther game half GH2 (for illustration purposes and the closer game half GH1 has not been fully outfitted for playing.
Figure 3:
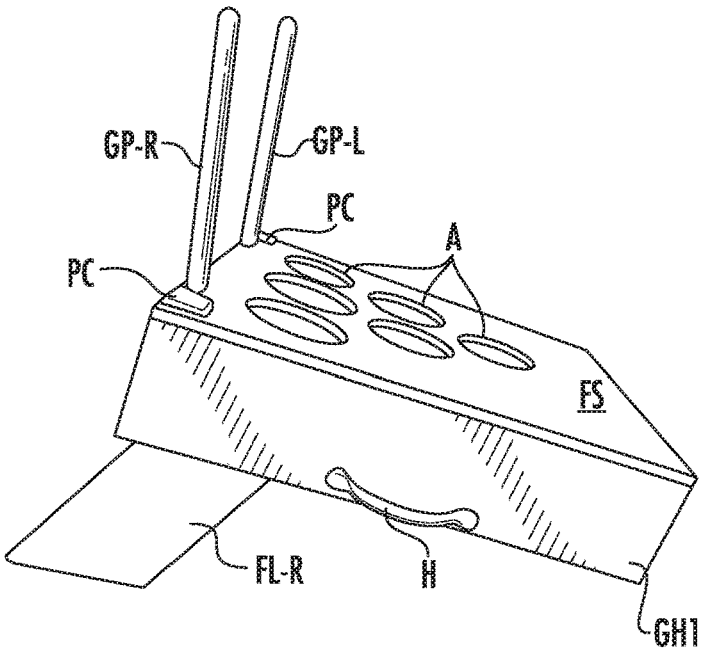
FIG. 3 is a side plan view showing one of the two main game board halves GH1 with its retractable rear legs FL-R fully extended (and locked into place) and its two removable goalposts GP-L, GP-R attached with end post clips PC onto the main flat playing surface FS that has a plurality of apertures A (for aesthetics, that flat surface may have chalk lines and other field markings added though not shown here)
Figure 4:
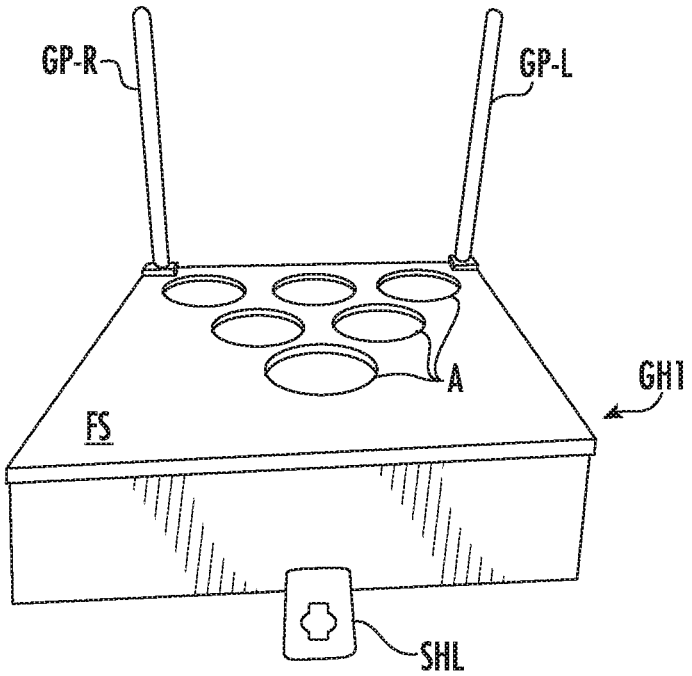
FIG. 4 is a front plan view of game board half GH1 from FIG. 3 with its own securing hook latch SHL for holding the game board half to the ground when played outdoors on a dirt or grassy surface.

Referring now to the drawings, there is shown a first version of game board per this invention, divisible into two equally sized and shaped game "halves", GH1 and GH2, which can be joined together, per item 10, for transport and/or storage when not in use. When joined, the two sections are provided with a carrying handle H and lockable latch L for connecting the two halves to one another. A slidable hinge arrangement (not seen) would allow the two game halves to connect at the opposite ends of latch L if a second locking latch was not configured on the opposite ends of both GH1 and GH2. In play, the two game halves are spaced apart from one another a set distance D. In one embodiment, the two halves are set apart (for play) three feet from the fronts to both sections GH1 and GH2. For more skilled play, that distance can be increased, even doubled.

The flat playing surfaces of each half, FS, is substantially planar and has a plurality, preferably six, beer cup holding holes or apertures A cut therein. Note that in this first main embodiment, the six holes are intentionally sized so that a standard Solo® beer pong cup BPC, empty or full, sits almost flush into apertures A. Note further that the six holes are patterned like a standard beer pong game arrangement, one centered, two in the second row and three in the final (of three) rear holed rows. Alternately, the two halves may be partially sloped (rather than equally planar) but nevertheless fit together to form a squared or rectangular shaped with complementary first and second halves GH1, GH2. Also, alternately, it is anticipated that a longer game variation (under a different name than "Flick to 42" may include 10 such cup holding holes in a standard bowling pin arrangement (not shown).

The six-holed top flat surface (face) FS to this game board is color coated with a collegiate logo. It is understood that these same front faces may be painted in complementary school colors (i.e. one half blue and the other yellow), or in colors matching those of a professional sports team (with proper licensing rights in place). Alternately, the two playing field halves can be painted green to match that of a grass field. That green surface could even be fully or partially lined to resemble a football playing field with hash marks and the like.

Figure 5:
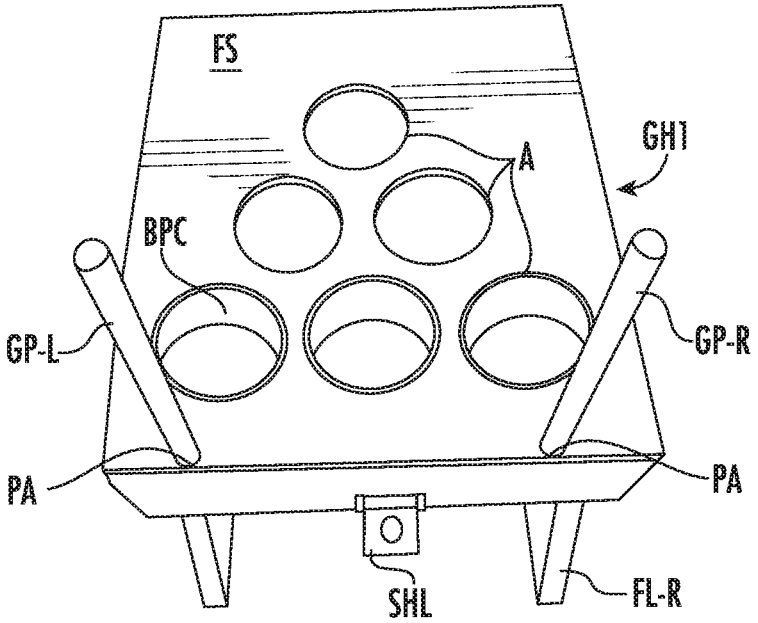
FIG. 5 is a top plan view from the rearward end of main game board half GH1 from FIGS. 3 and 4, with its two rear legs FL-R extended and locked into place. Note that instead of clipping the goal posts GP-L and GP-R to the rear edge of Flat Surface FS, this alternate version has a post aperture PA into which the posts are secured for game play.

A pair of removable goal posts GP-L, GP-R may clamp to both the left AND right rears of flat surface FS using post clamps PC. They assist game players with gauging whether the opposing player has duly flicked his/her football there through for earning the necessary 'extra point'. In another version of this game, side goal post pairs GP-L, GP-R (each stored within the two halves when not in use) can fit in appropriately spaced post apertures PA a set distance apart from one another (see, FIG. 5). Alternately, the two posts could be secured to each rear end of a half game board with swing-up type hinge mechanisms . . . for swinging down and storing safely away when the game is not being played.

Figure 6:
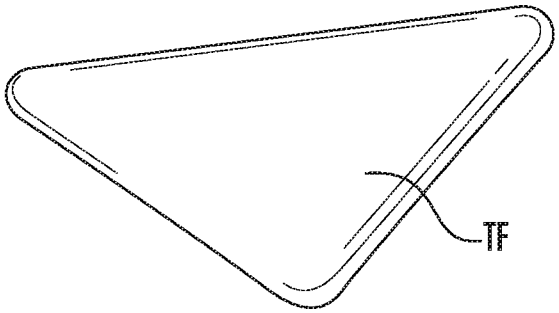
FIG. 6 is a top plan view of a first variety of triangular finger kicking football TF (made from plastic) for use with one version of this recreational game, this version that may further include a sports football logo thereon.
Figure 7:
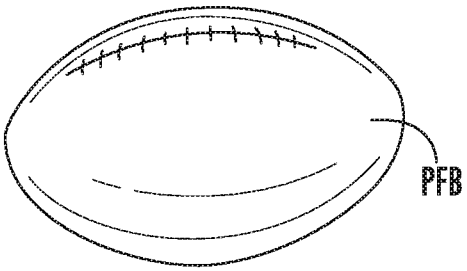
FIG. 7 is a top plan view of a second variety of plastic finger kicking, mini football PFB.

The playing pieces (i.e., footballs) for flicking into the respective cups AND through the uprights are preferably made from a soft plastic so as to be waterproof and survive the repeated immersions into various cups of beer or other liquid. One version has these footballs made from triangular sections TF (see, FIG. 6) . . . with the possibility of adding a professional sports or college team logo thereto for promotional tie-in purposes. Another version employs a mini-football, plastic shape PFB (FIG. 7) that can be finger-nicked per the detailed rules below. Alternately, footballs can be made from a Nerf®-type rubber material. In playing the games, these balls are held against the back edge of a first game half with a player's pointer finger of one hand before being kicked towards the other game half's set of beer cups and/or rear goal posts using a finger (index, middle) of the player's other hand.

In a more elaborate alternative, the games can be fitted with miniature, mechanical kickers as have been invented and known over time. One such version would require placing the football on a kicker's tee before bopping the kicker on the top helmet/head for causing the kicker's leg to swing and kick the ball towards its intended goal(s).

While the present invention is not limited to specific sizes, the following dimensions are suggested for a practical size of the game halves. Each game half GH1, GH2 may measure 15 inches wide, 16 inches long and 8 inches tall (in back) with a standard goal post GP-L, GP-R (about 8 inches long) being spaced about 8 inches apart from its matching pair on the rear wall corners of each game half.

The game device would be provided with an instruction leaflet or booklet (not shown) that includes the playing and scoring rules for a variation of games. Optionally, some sort of scoreboard (counter) may also be included.

One preferred set of game playing and scoring rules includes:

1. A first player "kicks" his/her ball with a flick of the finger, from the "end zone" or area of play between his/her goalposts on his/her game board half, towards a first of the set of six beer playing cups filled into the holes on the opposite game board half preferably spaced about 3 feet away from his/her own front of game board half.

2. If that first kick lands in a duly filled cup of beer on the opposing player's game half, the ball is recovered; and the beer is assigned to a drinker to drink, i.e., empty, usually the opposing player is that drinker. Then that cup may be refilled with a new (more) beer.

3. The successful kicker then returns to his/her own end zone for attempting an extra point—i.e. through the other player's raised goal posts.

a. if successful, that same player has achieved his/her first 7 points and that same player's turn continues with another "round" by trying to next kick the ball into one of the remaining five target cups.

b. if he/she misses the extra point, that player has only earned 6 points and play passes to the other player to attempt his/her first cup-landing touchdown. In other words, a flicker CANNOT shoot for another full cup until he/she makes an extra point in successive turns/attempts.

4. Turns alternate between players until a first player reaches 42 points (i.e. all six cups have been hit AND six extra points have been made).

5. In a first preferred optional play, even after the first player reaches 42, the second player may be given ONE shot at redemption to keep playing (i.e. hitting all remaining targets and making all successive extra points) so as to achieve a tie game.

Alternative or Optional Rules:

A1. When landing in an already landed in (and emptied) cup, that player may: (a) lose the chance to continue; (b) lose his/her next turn as well, giving the other player two successive plays; (c) have some points deducted; and/or (d) have to drink a penalty—shot, etc.

A2. When a mechanical kicker is used for play, THE FINAL extra point—to win the game—would have to be done with a finger flick (without using the mechanical kicker).

A3. Overtime would be a continuation of play until first player that misses after opponent scores would lose. i.e., 49 scores and next player misses the cup to tie.

A4. "Professional Version" would be played the same way as regular beer pong. Each player must hit every single cup and extra point first to win game. They can "re-rack" their shooting cup arrangements 1× per game.

While various changes may be made in the detail construction, it is understood that such changes will be within the spirit and scope of the present invention, as is defined by the appended claims.

I claim:

1. A finger flicking football game comprising:

(a) a waterproof, triangular-shape football adapted for flicking with a player's finger; and (b) a pair of transportable game boards, each transportable game board comprising:

(i) a planar table surface having a six of apertures arranged in rows of one, two and three apertures from a front to a rear of the flat playing surface, each of the plurality of apertures configured to hold a cup adapted for use in playing a beer pong drinking game, wherein said apertures are configured to hold cups to serve as targets into which players of said game to flick said football to score a six point touchdown; and (ii) a pair of goal posts removably mounted to each planar table surface at a rear end thereof; wherein during game play, each pair of goal posts serving as targets through which a first player may finger flick the football for earning an extra point after having successfully finger flicked the football into one of said targets.

2. The finger flicking game of claim 1 wherein the goal posts are removable for storage when not in use for game play.

3. The finger flicking game of claim 1 wherein the goal posts are hinged for swinging down when not in use for game play.

4. A method for playing a tailgate party game that combines beer pong and cornhole said method comprising the steps of:

a. providing a waterproof, triangular-shaped football adapted for flicking with a player's finger and a pair of transportable game boards, each game board comprising: (i) a flat playing surface with six apertures arranged in rows of one, two and three apertures from front to rear of the flat playing surface, each aperture configured to hold a cup sized for use in a beer drinking game; and (ii) removably mounted to each playing surface at a rear end thereof; wherein during game play, said goal posts adapted for having the football finger flicked therethrough to earn an extra point during a turn of game play;

b. providing a first player with a turn for flicking, with the first player's finger, the football from the first player's flat playing surface towards the cups in the second player's flat playing surface a set distance apart from the first player's playing surface, said first player either: (i) landing the football in one of the second player's cups to score a touchdown (6 points) and earn the chance to attempt flicking for an extra point; or (ii) missing the second player's cups after which; turn of play passes to the second player;

c. providing each player who scores a touchdown an opportunity to attempt finger flicking the football through the second player's goal posts for earning an extra point, and if that attempt is successful, turn of play remains with that player to attempt scoring another touchdown by finger flicking the football into one of the other remaining cups on the second player's playing surface; and d. providing both players alternating turns to finger flick footballs into all six of the other player's cups and attempt extra points after every touchdown scored until a total of at least 42 points is reached.

5. The method of claim 4 wherein a winning player must successfully kick one extra point before a game ends.

6. The method of claim 5 wherein after a first player reaches 42 points, the other player is given one last chance to continue scoring and kicking to at least tie or win the game.

7. The method of claim 4 wherein points are deducted from a player's score after two or more consecutive misses.

* * * * *